US007106009B2

(12) United States Patent
Huang

(10) Patent No.: US 7,106,009 B2
(45) Date of Patent: Sep. 12, 2006

(54) DUPLEXING PROTECTION APPARATUS AND OPERATION METHOD THEREOF

(75) Inventor: Shih-Chung Huang, Taipei (TW)

(73) Assignee: Beyond Innovation Technology Co., Ltd., Taipei (TW)

( * ) Notice: Subject to any disclaimer, the term of this patent is extended or adjusted under 35 U.S.C. 154(b) by 0 days.

(21) Appl. No.: 10/904,546

(22) Filed: Nov. 16, 2004

(65) Prior Publication Data

US 2005/0248298 A1 Nov. 10, 2005

(30) Foreign Application Priority Data

May 4, 2004 (TW) ..... 93112472 A

(51) Int. Cl.
*H05B 37/02* (2006.01)

(52) U.S. Cl. ..... 315/308; 315/324

(58) Field of Classification Search ..... 315/200 R, 315/201, 291, 307, 308, 312, 324
See application file for complete search history.

(56) References Cited

U.S. PATENT DOCUMENTS 6,114,814 A 9/2000 Shannon et al. ..... 315/219
6,259,615 B1 7/2001 Lin ..... 363/98
6,316,814 B1 11/2001 Nagata et al. ..... 257/435
6,351,074 B1 * 2/2002 Ito et al. ..... 315/82
6,420,839 B1 * 7/2002 Chiang et al. ..... 315/311
6,501,234 B1 12/2002 Lin et al. ..... 315/307
6,563,275 B1 * 5/2003 Ito et al. ..... 315/308
6,583,570 B1 * 6/2003 Ito et al. ..... 315/82
6,707,264 B1 3/2004 Lin et al. ..... 315/307
6,717,372 B1 * 4/2004 Lin et al. ..... 315/282
6,750,842 B1 6/2004 Yu ..... 345/102
2003/0142060 A1 * 7/2003 Lee et al. ..... 345/102
2005/0093461 A1 * 5/2005 Cull et al. ..... 315/149

* cited by examiner

*Primary Examiner*—Thuy Vinh Tran
(74) *Attorney, Agent, or Firm*—Jianq Chyun IP Office

(57) ABSTRACT

A lamp duplexing protection apparatus comprises a first lamp module and a second lamp module. The first lamp module outputs a first decision signal according to whether the first lamp operates normally. The second lamp module outputs a second decision signal according to an operating status of the second lamp. The first lamp module determines whether to supply power to the first lamp according to the second decision signal. The second lamp module determines whether to supply power to the second lamp according to the first decision signal.

17 Claims, 9 Drawing Sheets

DUPLEXING PROTECTION APPARATUS AND OPERATION METHOD THEREOF

CROSS-REFERENCE TO RELATED APPLICATION

This application claims the priority benefit of Taiwan application serial no. 93112472, filed May 4, 2004.

BACKGROUND OF THE INVENTION

1. Field of the Invention

The present invention relates to a lamp protection apparatus and an operation method thereof, and more particularly to a series lamp duplexing protection apparatus and an operation method thereof.

2. Description of Related Art

Fluorescent Lamp (FL) has been applied to the backlight system of LCD because of its advantages of better emission efficiency and longer life time compared to traditional lamp. With advancement of the LCD technology, it is possible to manufacture LCD with larger screen size than before. By this trend, a multiple-lamp system applied to LCD has also become more sophisticated.

In the multiple-lamp system, usually multiple controllers of cold cathode fluorescent lamps are used. Due to the structure of the multiple controllers, the communication between these controllers is more complicated than that of a single controller. The improvement of communication between the controllers becomes important, especially when the improvement is essentially related to safety concern. Traditional protection approach usually adopts a parallel protection system. Each of lamps coupled to the common control line in order to obtain protection therefrom. The whole backlight system of LCD is, therefore, protected by such design.

FIG. 5 is a circuit block diagram of a conventional two-lamp protection apparatus. Referring to FIG. 5, the two-lamp protection apparatus comprises a first converter 502, a second converter 522, a first fluorescent lamp 504, a second fluorescent lamp 524, a first lamp current detecting circuit 506, a second lamp current detecting circuit 526, a first lamp current decision circuit 508, a second lamp current decision circuit 528, a first lamp current control circuit 514, a second lamp current control circuit 534 and an AND gate 540. The first lamp current control circuit 510 comprises a first feedback compensation circuit 512 and a first pulse width modulator (PWM) 514. The second lamp current control circuit 530 comprises a second feedback compensation circuit 532 and a second pulse width modulator (PWM) 534. The circuits constitute the current modification circuit for stabilizing the operational current and output brightness of the first fluorescent lamp 504 and the second fluorescent lamp 524.

For protection design of the prior art technology, the detection of the operational currents of the first fluorescent lamp 504 and the second fluorescent lamp 524 are used to determine whether the fluorescent lamp fails. The first lamp current decision circuit 508 and the second lamp current decision circuit 528 output a first lamp turn-off signal and a second lamp turn-off signal, respectively, to the AND gate 540. According to these turn-off signals, the AND gate 540 outputs signals to the first lamp current control circuit 510 and the second lamp current control circuit 540. When either fluorescent lamp fails, the system controls the first lamp current decision circuit 508 or the second lamp current decision circuit 528 to remove the power supplied to the first fluorescent lamp 504 or the second fluorescent lamp 524.

FIG. 6 is a circuit block diagram of a conventional three-lamp protection apparatus. In addition to these circuits described in FIG. 5, the three-lamp protection apparatus in FIG. 6 also comprises a third converter 642, a third fluorescent lamp 644, a third lamp current detecting circuit 646, a third lamp current decision circuit, a third lamp current control circuit 650 and AND gates 662 and 664. The third lamp current control circuit 650 comprises a third feedback compensation circuit 652 and a third PWM 654. The operations of the three-lamp protection apparatus in FIG. 6 are similar to those of the two-lamp protection apparatus in FIG. 5. Detailed descriptions are not repeated.

According to the above description with reference to FIGS. 5 and 6, an additional lamp circuit must include an AND gate. Each decision circuit must be separately coupled to the AND gate and the output terminal of one of the AND gates must be coupled to the control circuits. As a result, the number of devices in the circuit is increased and the circuit is complicated. When more and more lamps are used, manufacturing costs and the complexity of the circuit are unfavorably increased due to the increase of devices.

SUMMARY OF THE INVENTION

Accordingly, the present invention is directed to a lamp duplexing protection apparatus having simplified the circuit including a duplexing-operation structure transmitting signals in series.

The present invention is directed to a lamp duplexing protection apparatus having lesser number of devices compared to the conventional lamp protection apparatus including a duplexing-operation structure transmitting signals in series.

The present invention is also directed to a method of operating a lamp duplexing protection apparatus. According to an embodiment of the present invention, when any lamp operates abnormally, all the lamps are turned off.

The present invention is also directed to a method of operating a lamp duplexing protection apparatus capable of suppressing abnormal operations of the lamp duplexing protection apparatus by transmitting signals in series.

According to an embodiment of the present invention, the lamp duplexing protection apparatus comprises a first lamp module and a second lamp module. The first lamp module is coupled to a power source. The first lamp is adapted for outputting a decision signal according to an operating status of the first lamp. The second lamp module is coupled to the power source and the first lamp module. The second lamp is adapted for receiving the first decision signal and outputting a second decision signal according to an operation status of the second lamp. The first lamp module is also adapted for receiving the second decision signal and for determining whether or not to supply power to the first lamp according to the second decision signal. The second lamp module determines whether to supply power to the second lamp according to the first decision signal.

The present invention is also directed to lamp duplexing protection apparatus comprising a first lamp module, a second lamp module and a third lamp module. The first lamp module is coupled to a power source and is adapted for outputting a decision signal according to an operation status of the first lamp. The second lamp module is coupled to the power source and the first lamp module, and is adapted for receiving the first decision signal and outputting a second decision signal according to an operation status of the second lamp. The third lamp module is coupled to the power source, the first lamp module and the second lamp module, and is adapted for receiving the second decision signal and outputting a third decision signal according to an operation status of the third lamp. The first lamp module is also adapted for receiving the third decision signal and for determining whether or not to supply power to the first lamp according to the third decision signal. The second lamp module determines whether or not to supply power to the second lamp according to the first decision signal. The third lamp module determines whether or not to supply power to the third lamp according to the second decision signal.

The present invention is directed to a method of operating a lamp duplexing protection apparatus. The lamp duplexing protection apparatus comprises a first lamp and a second lamp. During the operation of the lamp duplexing protection apparatus, currents flowing through the first lamp and the second lamp are separately detected. A first decision signal and a second decision signal are outputted according to the above detection results. The first decision signal decides whether or not to supply power to the second lamp. The second decision signal decides whether or not to supply power to the first lamp.

The present invention is also directed to method of operating a lamp duplexing protection apparatus. The lamp duplexing protection apparatus comprises a first lamp, a second lamp and a third lamp. During the operation of the lamp duplexing protection apparatus, currents flowing through the first lamp, the second lamp and the third lamp are separately detected. A first decision signal, a second decision signal and a third decision signal are outputted according to the above detection result. The first decision signal decides whether or not to supply power to the second lamp. The second decision signal decides whether or not to supply power to the third lamp. The third decision signal decides whether or not to supply power to the first lamp.

Accordingly, the duplexing protection apparatus according to an embodiment of the present invention transmits signals in series for controlling the lamps. Because lesser number of devices compared to the conventional lamp protection apparatus is required, therefore the design of the circuit is simplified. Accordingly, manufacturing cost is reduced making it more attractive on the market.

In order to make the aforementioned and other objects, features and advantages of the present invention understandable, a preferred embodiment accompanied with figures is described in detail below.

DESCRIPTION OF EMBODIMENTS

Figure 1A:
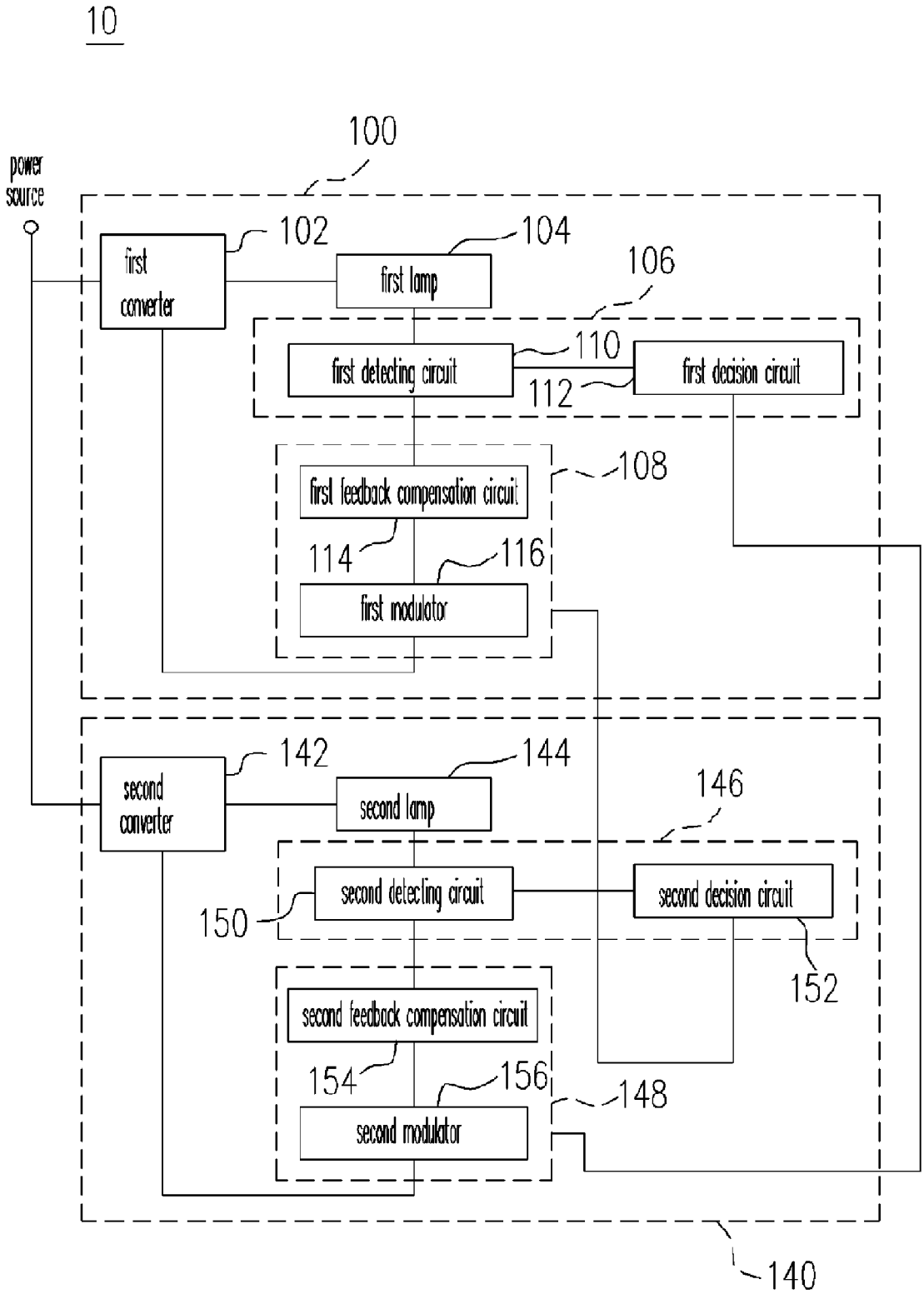
FIG. 1A shows a circuit block diagram represents a two-lamp duplexing protection apparatus according an embodiment of the present invention.

FIG. 1 A shows a circuit block diagram of a two-lamp duplexing protection apparatus according an embodiment of the present invention. In this embodiment, the two-lamp duplexing protection apparatus 10 comprises a first lamp module 100 and a second lamp module 140. Both of the lamp modules 100 and 140 are coupled to a power source. The first lamp module 100 and the second lamp module 140 output a first decision signal and a second decision signal, respectively.

According to this embodiment, the first lamp module 100 comprises a first converter 102, a first lamp 104, a first detecting-decision circuit 106 and a control circuit 108. The first converter 102 is coupled to the power source and the first lamp 104. The first converter 102 converts electrical power from the power source and supplies it to the first lamp 104. The first detecting-decision circuit 106 is coupled to the first lamp 104 and is adapted for outputting a first detecting signal and a decision signal. The first control circuit 108 is coupled to the first detecting-decision circuit 106 and is adapted for outputting a first control signal according to the first detecting signal and the second decision signal outputted from the second lamp module 140. The first converter 102 determines whether or not to output power according to the first control signal.

In this embodiment, the second lamp module 140 comprises a second converter 142, a second lamp 144, a second detecting-decision circuit 146 and a second control circuit 148. The functions and operations of the second lamp module 140 are similar to those of the first lamp module 100. The detailed descriptions are not repeated.

In this embodiment, the first detecting-decision circuit 106 comprises a first detecting circuit 110 and a first decision circuit 112. The first detecting circuit 110 is coupled to the first lamp 104 and is adapted for detecting the current flowing through the first lamp 104 to output a first detecting signal. The first decision circuit 112 is coupled to the first detecting circuit 110 and is adapted for controlling the current flowing through the first lamp 104 and output a first decision signal. The second detecting-decision circuit 146 comprises a second detecting circuit 150 and a second decision circuit 152. The operations and functions of the second detecting circuit 150 and the second decision circuit 152 are similar to those of the first detecting circuit 110 and the first decision circuit 112, respectively. Detailed descriptions are not repeated.

According to this embodiment, the feature of the present invention resides on the first decision circuit 112 of the first lamp module 100 coupled to the second control circuit 148; and the second decision circuit 152 of the second lamp module 140 coupled to the first control circuit 108.

Figure 1B:
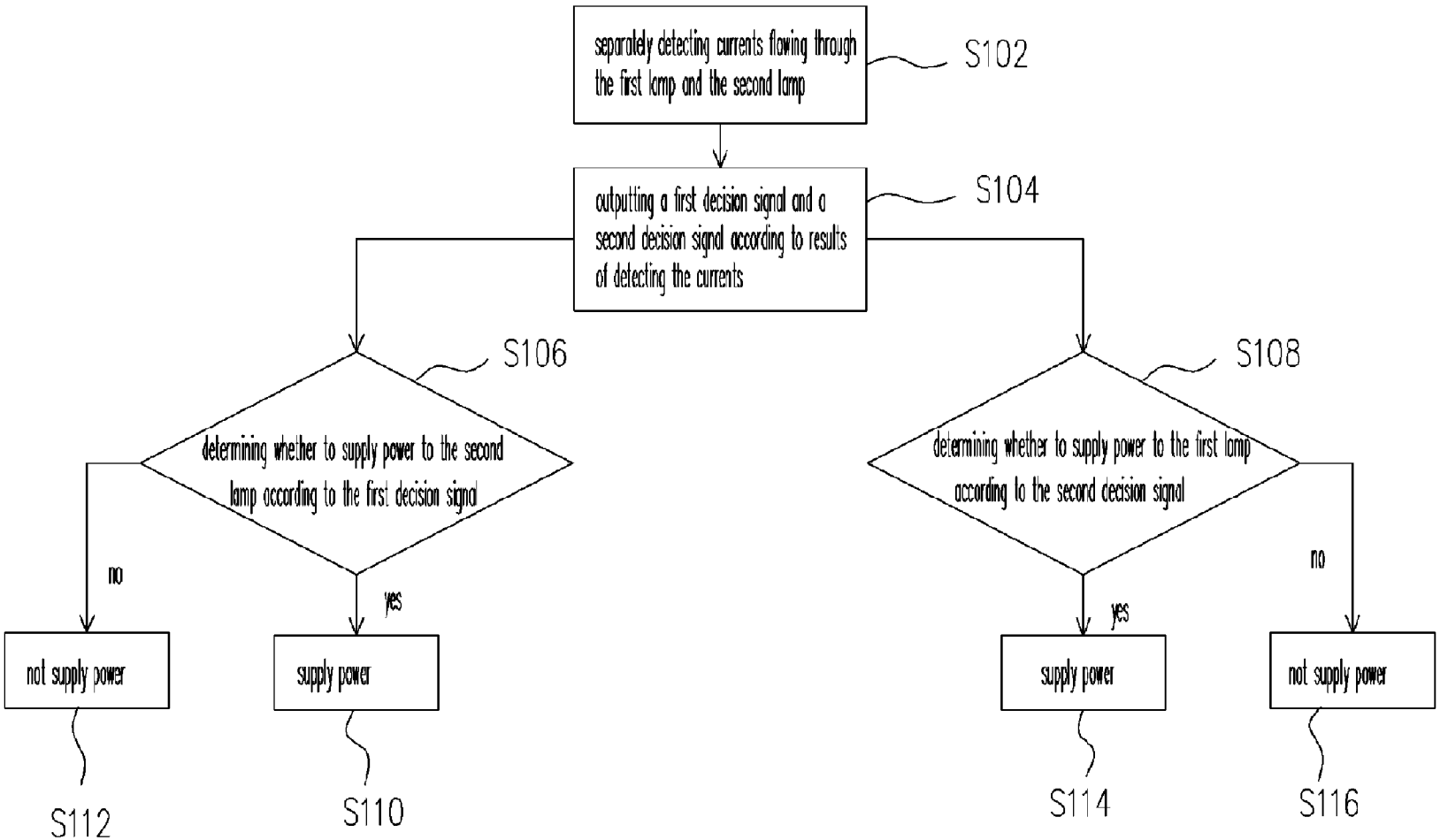
FIG. 1B is an operation flowchart of a two-lamp duplexing protection apparatus according to an embodiment of the present invention.

FIG. 1B is an operation flowchart of a two-lamp duplexing protection apparatus according to an embodiment of the present invention. Referring to FIGS. 1A and 1B, after the first lamp module 100 and the second lamp module 140 are enabled, the first converter 102 and the second converter 142 separately receive and convert power from the power source. After conversion, the power is outputted to the first lamp 104 and the second lamp 144.

After the first lamp 104 and the second lamp 144 are enabled, the first detecting circuit 110 and the second detecting circuit 150 detect currents flowing through the first lamp 104 and the second lamp 144 and output a first detecting signal and a second detecting signal, respectively (at step s102). The first decision circuit 112 and the second decision circuit 152 output a first decision signal and a second decision signal respectively according to the detection results above (at step s104).

In this embodiment, the first control circuit 108 receives the first detecting signal outputted from the first detecting circuit 110 and the second decision signal outputted from the second decision circuit 152. The second control circuit 148 receives the second detecting signal outputted from the second detecting circuit 150 and the first decision signal outputted from the first decision circuit 112. The first control circuit 108 calculates these signals and outputs a first control signal to the first converter 102 and determines whether or not to provide power to the first lamp 104 according to the first detecting signal and the second decision signal (at step s106). The second control circuit 148 calculates these signals and outputs a second control signal to the second converter 142 and determines whether or not to provide power to the second lamp 144 according to the second detecting signal and the first decision signal (at step s108).

After determining whether or not to provide power to the first lamp 104, the first converter 102 operates normally (at step s110). When it is determined not to provide power to the first lamp 104, the first converter 102 is turned off (at step s112). When it is determined to provide power to the second lamp 144, the second converter 142 operates normally (at step s114). When it is determined not to provide power to the second lamp 144, the second converter 142 is turned off (at step s116).

Figure 3A:
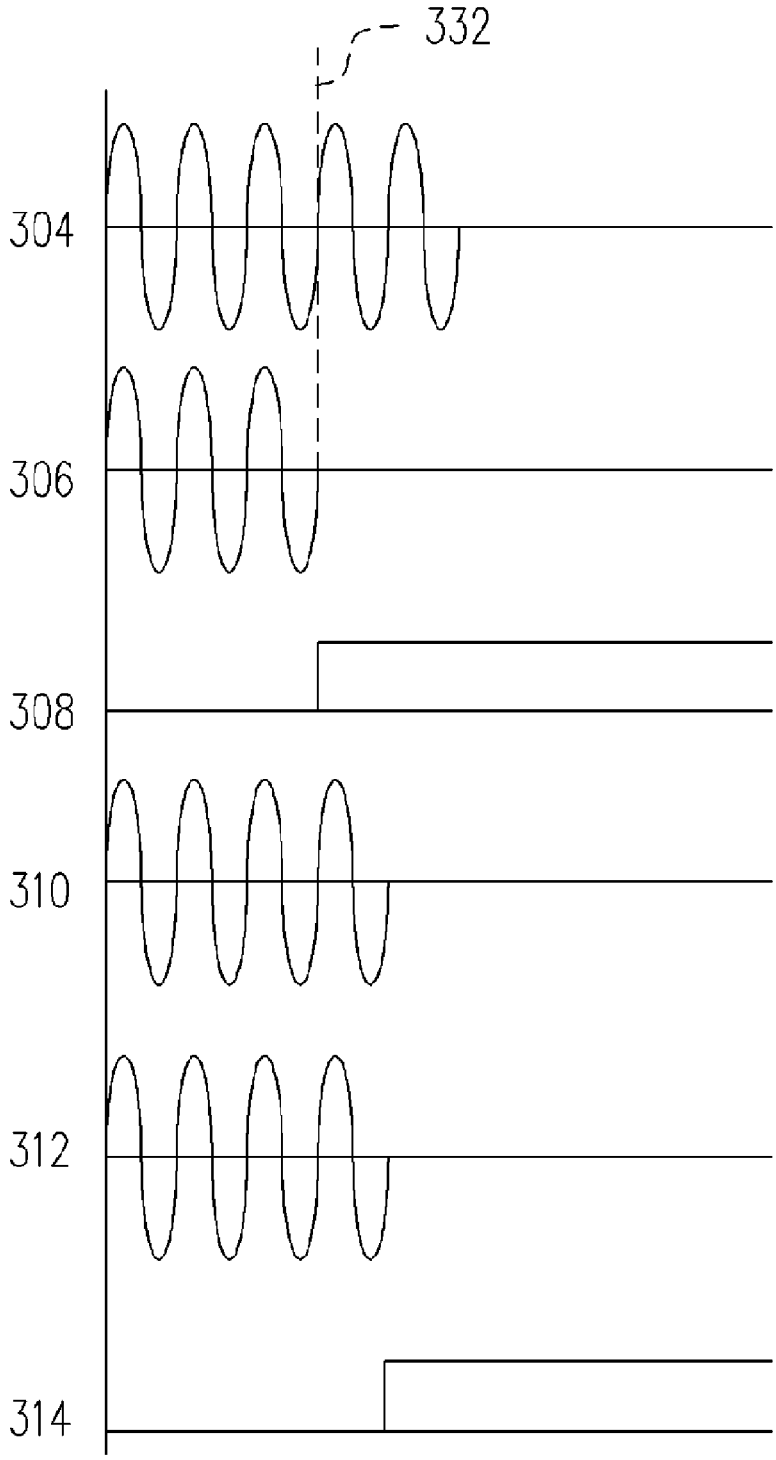
FIG. 3A is a time chart of a two-lamp duplexing protection apparatus according to an embodiment of the present invention.

FIG. 3A is a time chart of a two-lamp duplexing protection apparatus according to an embodiment of the present invention.

Referring to FIG. 3A, when first lamp 102 fails at the failure point 332, the first lamp 102 continues to output a voltage with waveform 304, but no current flows through the first lamp 102 (like waveform 306). A turn-off signal 308, such as a first decision signal, is triggered. The transmission of turn-off signal 308 is delayed for a short period of time and is adapted for turning off the control circuit 148 of the second lamp 144. next, a turn-off signal 314 is triggered. After a short time delay, the turn-off signal 314 is transmitted to turn off the first control circuit 108. The voltage signal with waveform 304 of the first lamp 104 is brought to zero. Thus, after the control circuit 148 is turned off, current and voltage (waveforms 312 and 310) supply to the first lamp is cut off.

Figure 2A:
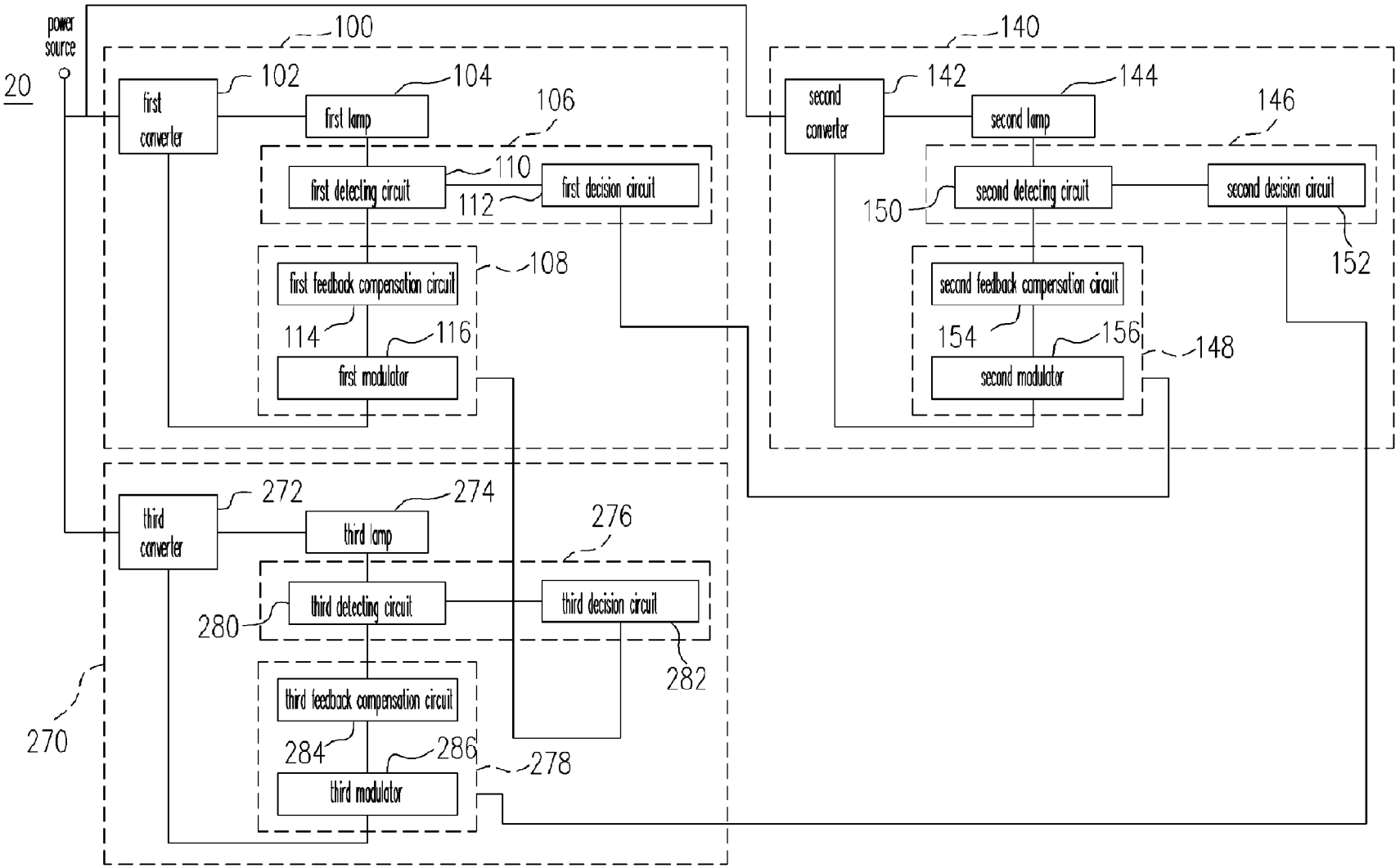
FIG. 2A is a circuit block diagram of a three-lamp duplexing protection apparatus according to an embodiment of the present invention.

FIG. 2A is a circuit block diagram of a three-lamp duplexing protection apparatus according to an embodiment of the present invention. This embodiment is similar to the embodiment of FIG. 1A except for an additional third lamp module 270. The third lamp module 270 comprises: a third converter 272, a third lamp 174, a third detecting-decision circuit 276 and a third control circuit 278. The operations and functions of the third lamp module 270 are similar to those of the first lamp module 100 or the second lamp module 140. Detailed descriptions are not repeated.

Compared to the embodiment in FIG. 1A, the first decision circuit 112 is coupled to the second control circuit 148; the second decision circuit 152 is coupled to the third control circuit 278, and the third decision circuit 282 is coupled to the first control circuit 116.

Figure 2B:
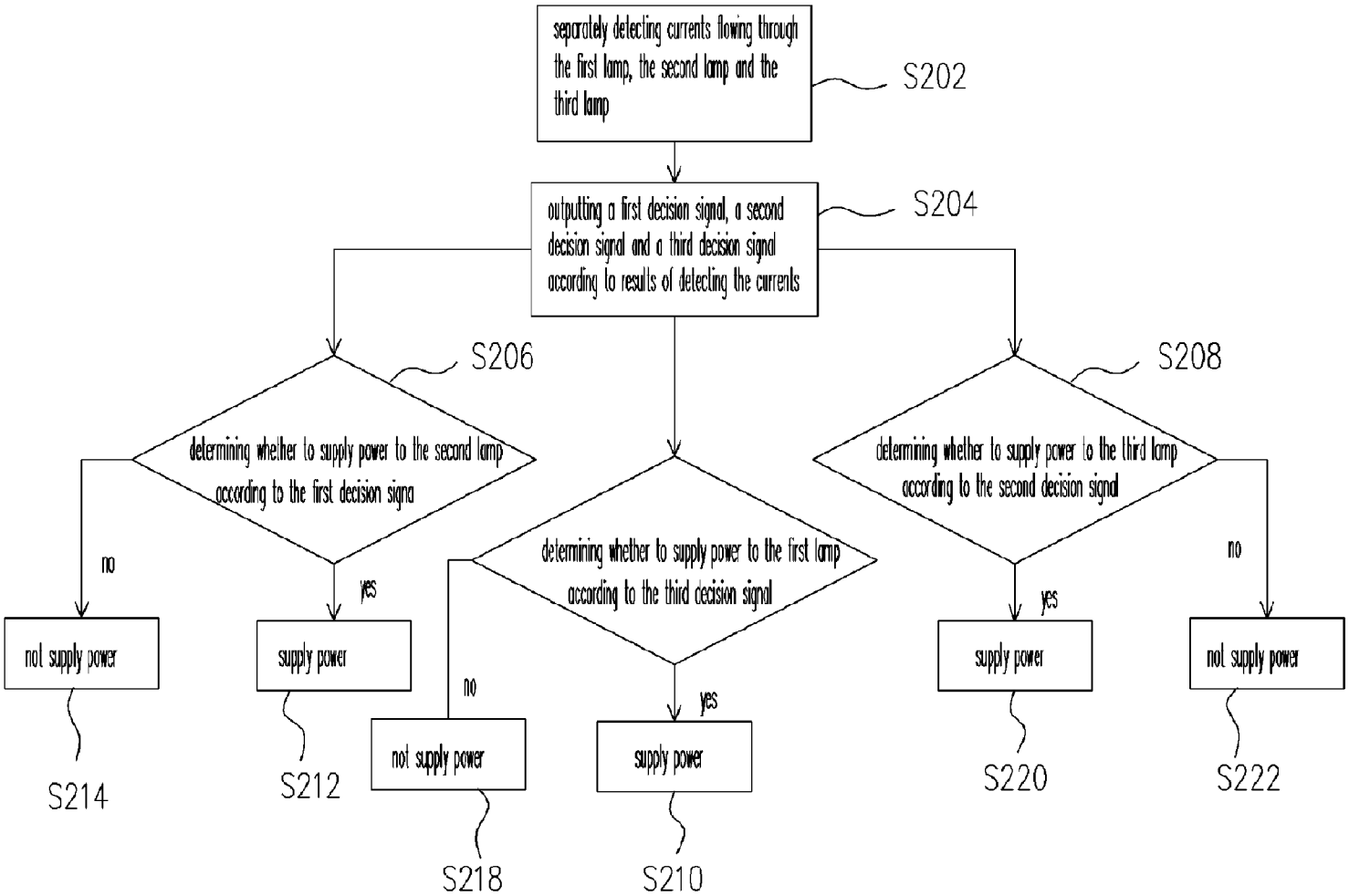
FIG. 2B is an operational flowchart of a three-lamp duplexing protection apparatus according to an embodiment of the present invention.

FIG. 2B is an operational flowchart of a three-lamp duplexing protection apparatus according to an embodiment of the present invention. Referring to FIGS. 2A and 2B, after the first lamp module 100, the second lamp module 140 and the third lamp module are enabled, the first converter 102, the second converter 142 and the third converter 272 separately receive and convert electrical power from the power source. After conversion, the power is outputted to the first lamp 104, the second lamp 144 and the third lamp 274.

After the first lamp 104, the second lamp 144 and the third lamp 274 are enabled, the first detecting circuit 110, the second detecting circuit 150 and the third detecting circuit 280 detect currents flowing through the first lamp 104, the second lamp 144 and the third lamp 274, and output a first detecting signal, a second detecting signal and a third detecting signal , respectively (at step s202). The first decision circuit 112, the second decision circuit 152 and the third decision circuit 282 output a first decision signal, a second decision signal and a third decision signal respectively according to the results of detecting the currents (at step s204).

In this embodiment, the first control circuit 108 receives the first detecting signal outputted from the first detecting circuit 110 and the third decision signal outputted from the third decision circuit 282. The second control circuit 148 receives the second detecting signal outputted from the second detecting circuit 150 and the first decision signal outputted from the first decision circuit 112. The third control circuit 278 receives the third detecting signal outputted from the third detecting circuit 280 and the second decision signal outputted from the second decision circuit 152. The first control circuit 108 calculates these signals and outputs a first control signal to the first converter 102 according to the first detecting signal and the third decision signal to determine whether or not to provide power to the first lamp 104 (at step s206). The second control circuit 148 calculates these signals and outputs a second control signal to the second converter 142 according to the second detecting signal and the first decision signal to determine whether or not to provide power to the second lamp 144 (at step s208). The third control circuit 278 calculates these signals and outputs a third control signal to the third converter 272 according to the third detecting signal and the second decision signal to determine whether or not to provide power to the third lamp 274 (at step s210).

After it is determined to provide power to the first lamp 104, the first converter 102 operates normally in step s212. When it is determined not to provide power to the first lamp 104, the first converter 102 is turned off (at step s214). After it is determined to provide power to the second lamp 144, the second converter 142 operates normally (at step s220). When it is determined not to provide power to the second lamp 144, the second converter 142 is turned off (at step s222). After it is determined to provide power to the third lamp 274, the third converter 272 operates normally (at step s216). When it is determined not to provide power to the third lamp 274, the third converter 272 is turned off (at step s218).

Figure 3B:
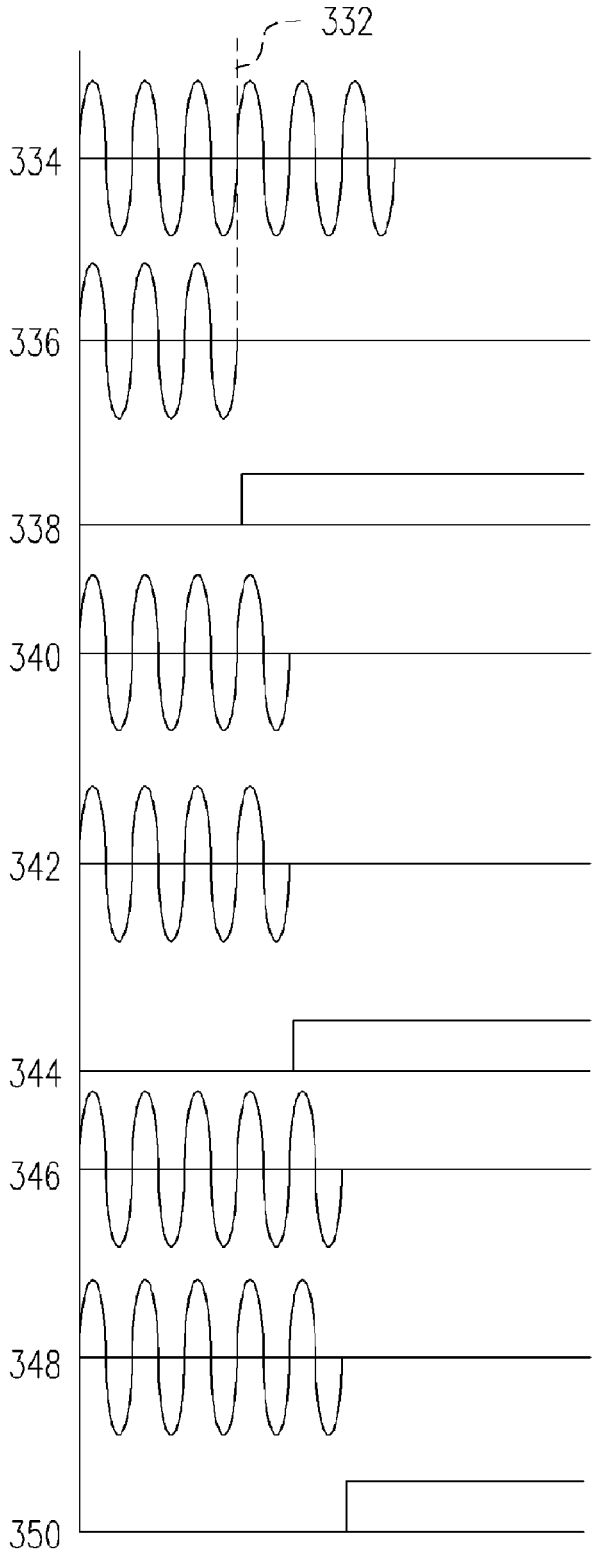
FIG. 3B is a time chart of a three-lamp duplexing protection apparatus according to an embodiment of the present invention.

FIG. 3B is a time chart of a three-lamp duplexing protection apparatus according to an embodiment of the present invention. Referring to FIG. 3B, when failing at the first lamp failure point 332, the first lamp 104 continues to output a voltage with waveform 334, but no current flows through the first lamp 104 (like waveform 336). A turn-off signal 338, such as a decision signal, is triggered. The turn-off signal 338 is delayed for a short time period and is adapted for turning off the control circuit 148 of the second lamp 144. After the control circuit 148 is turned off, no current and voltage (waveforms 312 and 310) is supplied to the first lamp 104. Next, a turn-off signal 334 is triggered. After a short time delay, the turn-off signal 334 is transmitted to turn off the third control circuit 278 of the third lamp 274. After the control circuit 278 is turned off, no current and voltage (waveforms 348 and 346) is supplied to the second lamp 144. Next, a turn-off signal 350 is triggered. After a short time delay, the turn-off signal is transmitted to turn off the first control circuit 108. The voltage signal with waveform 350 of the first lamp 104 is brought to zero.

Figure 4:
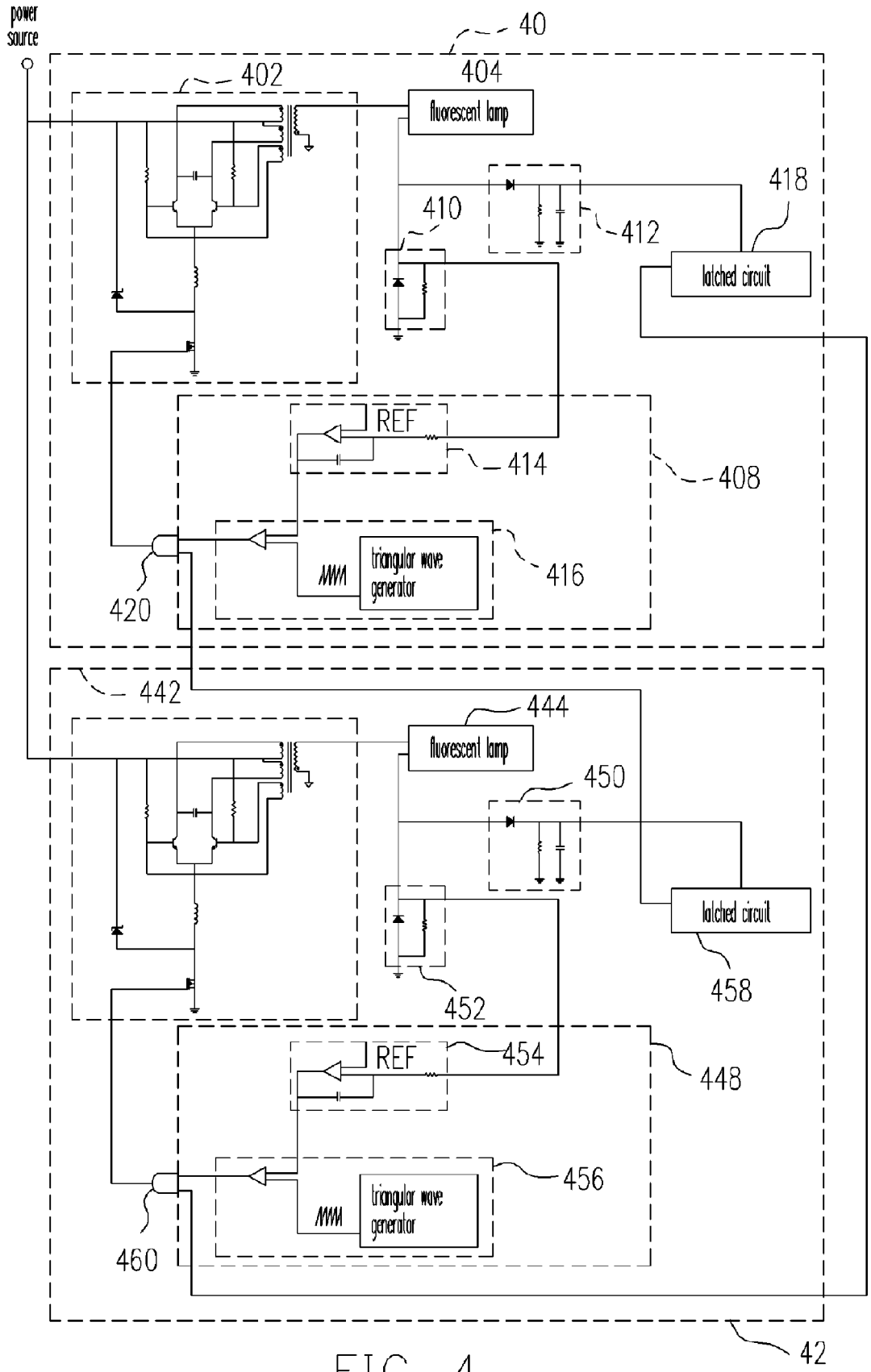
FIG. 4 is a detail circuit drawing of a two-lamp duplexing protection apparatus according to an embodiment of the present invention.
Figure 5:
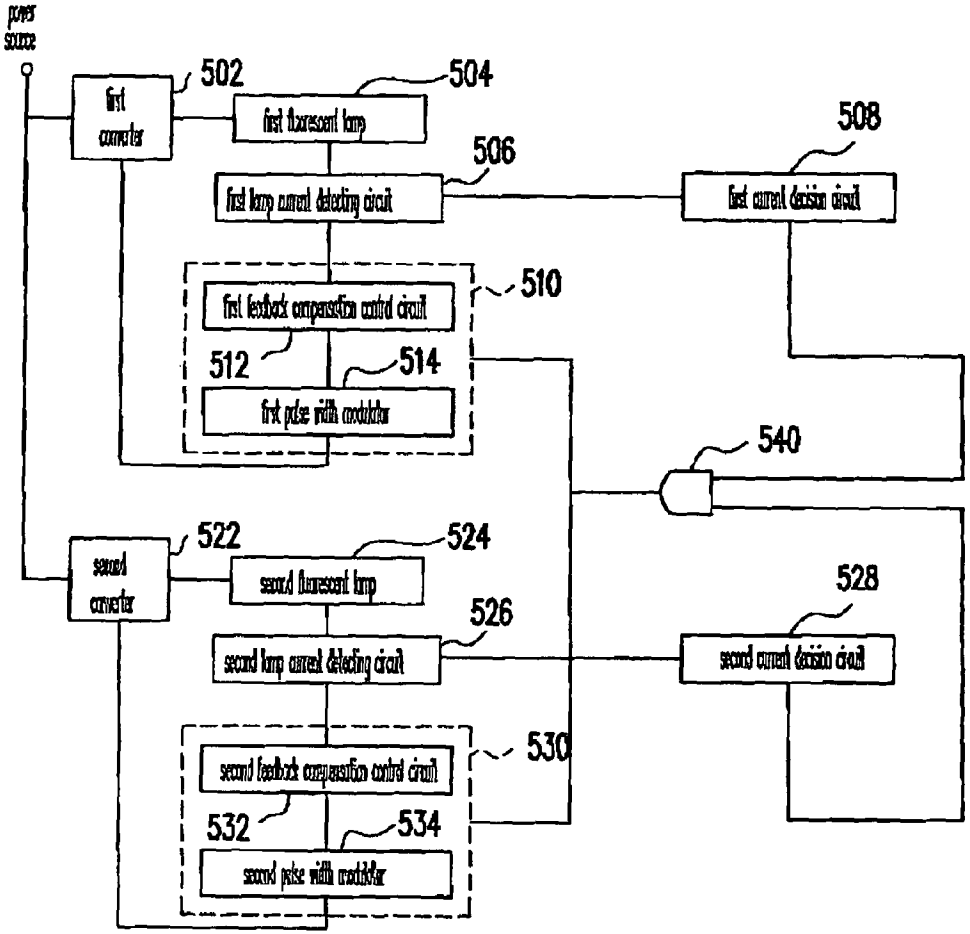
FIG. 5 (PRIOR ART)
FIG. 5 is a circuit block diagram of a prior art two-lamp protection apparatus.
Figure 6:
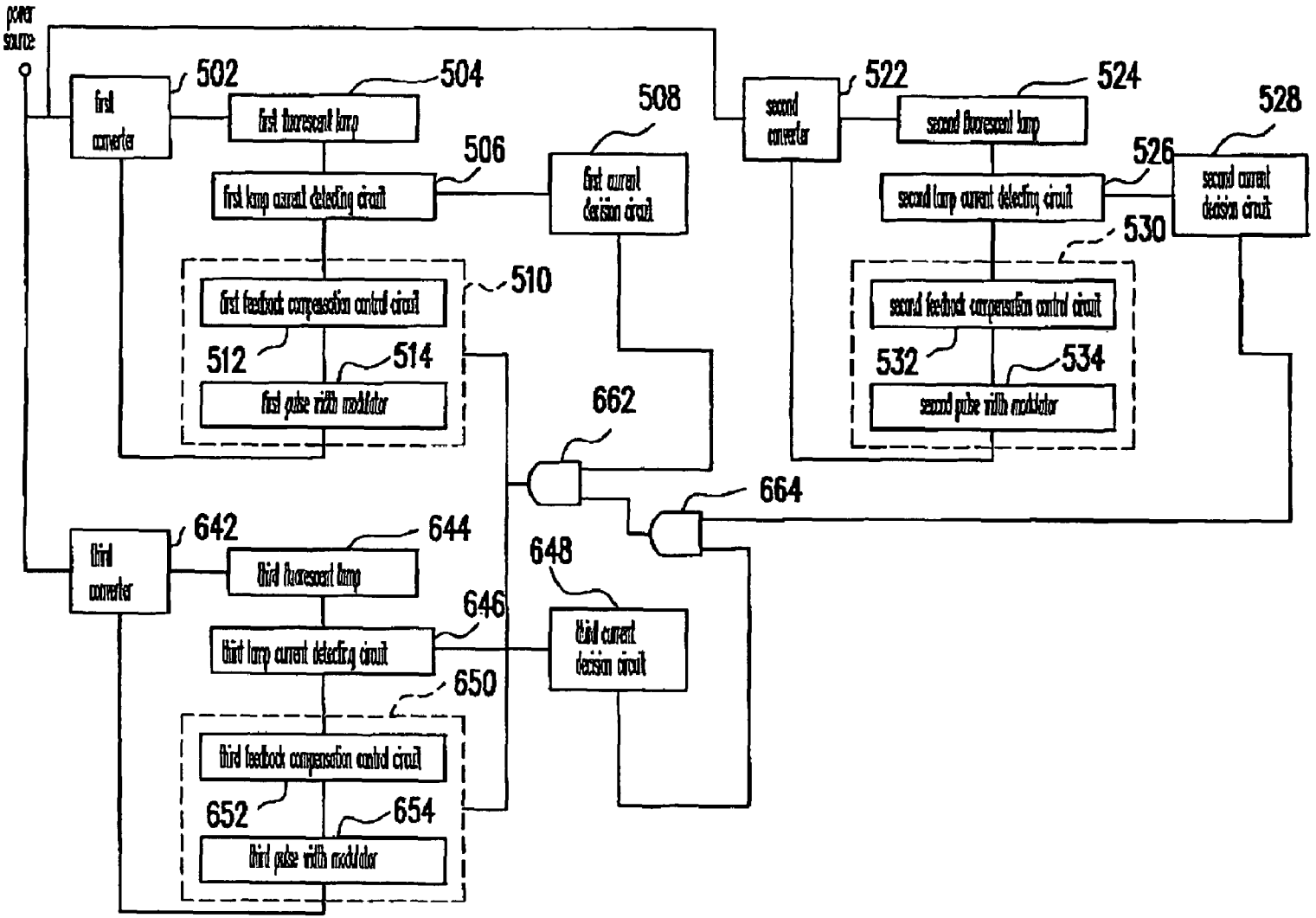
FIG. 6 (PRIOR ART)
FIG. 6 is a circuit block diagram of a prior art three-lamp protection apparatus.

FIG. 4 is a detail circuit drawing of a two-lamp duplexing protection apparatus according to an embodiment of the present invention. The circuit in FIG. 4 is an exemplary embodiment of the present invention. The scope of the present invention is not limited thereto. The two-lamp duplexing protection apparatus comprises lamp modules 40 and 42. The lamp module 40 comprises, for example, a converter 402, a fluorescent lamp 404, a detecting circuit 410, a decision circuit 412, a latched circuit 418, a control circuit 408, a feedback compensation circuit 414, a modulator 416 and an AND gate 420. The lamp module 42 comprises, for example, a converter 442, a fluorescent lamp 444, a detecting circuit 450, a decision circuit 452, a latched circuit 458, a control circuit 448, a feedback compensation circuit 454, a modulator 456 and an AND gate 460. The delay time can be, for example, 20 ms, but is not limited thereto.

One of ordinary skill in the art will understand that the converter, according to this embodiment of the present invention, can be an converter. The lamp can be a fluorescent lamp (FL) applied to liquid crystal display (LCD). The present invention, however, is not limited thereto.

One of ordinary skill in the art will understand that the control circuit, according to this embodiment of the present invention, comprises, for example, a feedback compensation and a pulse width modulator (PWM) to control the converter adjusting the power transmitted to the lamp.

Although the embodiments of the present invention described using the two-lamp or three-lamp duplexing protection circuit as examples, however the present invention is not limited to the two-lamp or three-lamp duplexing protection circuit, the present invention can be applied to a multiple-lamp system including the duplexing-operation structure with transmitting signals in series.

The lamp duplexing protection apparatus and the method of operating thereof according to the present invention have following advantages: (1) The design of the circuit is greatly simplified as lesser number of devices compared to the conventional lamp protection apparatus is required.

(2) Because lesser number of devices compared to the conventional lamp protection apparatus is required, therefore the manufacturing costs can be significantly reduced.

(3) The traditional parallel protection structure is improved into the duplexing-operation structure with transmitting signals in series to both simplify the circuit design and reduce cost.

(4) Because the design of the circuit is simplified, therefore it can be fabricated using simple process.

(5) Because the design of the circuit simplified due to lesser number of devices compared to the conventional lamp protection apparatus, therefore the process time and the cost can be reduced. Therefore, the throughput can be increased.

Although the present invention has been described in terms of exemplary embodiments, it is not limited thereto. Rather, the appended claims should be constructed broadly to include other variants and embodiments of the invention which may be made by those skilled in the field of this art without departing from the scope and range of equivalents of the invention.

What is claimed is:

1. A lamp duplexing protection apparatus, comprising:

a first lamp module comprising a first lamp, coupled to a power source, for outputting a decision signal according to an operating status of the first lamp; and a second lamp module comprising a second lamp, coupled to the power source and the first lamp module, for receiving the first decision signal and outputting a second decision signal according to an operating status of the second lamp operates, wherein the first lamp module receives the second decision signal, the first lamp module determines whether to supply power to the first lamp according to the second decision signal, and the second lamp module determines whether to supply power to the second lamp according to the first decision signal.

2. The lamp duplexing protection apparatus of claim 1, wherein the first lamp module comprises:

a first converter, coupled to the power source and the first lamp, for converting electrical power from the power source and supply electric power to the first lamp;

a first detecting-decision circuit, coupled to the first lamp, for detecting and controlling a current flawing through the first lamp to output a first detecting signal and the first decision signal; and a first control signal, coupled to the first detecting-decision circuit, for receiving the first detecting signal and the second decision signal, and outputting a first control signal according to the first detecting signal and the second decision signal, wherein the first converter determines whether to supply power according to the first control signal.

3. The lamp duplexing protection apparatus of claim 2, wherein the first detecting-decision circuit comprises:

a first detecting circuit, coupled to the first lamp, for detecting the current flowing through the first lamp to output the first detecting signal; and a first decision circuit, coupled to the first detecting circuit, for controlling the current flowing through the first lamp to output the first decision signal.

4. The lamp duplexing protection apparatus of claim 3, wherein the first control circuit comprises a first feedback compensation circuit and a first modulator.

5. The lamp duplexing protection apparatus of claim 4, wherein the second lamp module comprises:

a second converter, coupled to the power source and the second lamp, for converting electrical power from the power source and supplying electrical power to the second lamp;

a second detecting-decision circuit, coupled to the second lamp, for detecting and controlling a current flowing through the second lamp to output a second detecting signal and the second decision signal; and a second control signal, coupled to the second detecting-decision circuit, for receiving the second detecting signal and the first decision signal, and outputting a second control signal according to the second detecting signal and the first decision signal, wherein the second converter determines whether to supply power according to the second control signal.

6. The lamp duplexing protection apparatus of claim 5, wherein the second detecting-decision circuit comprises:

a second detecting circuit, coupled to the second lamp, for detecting the current flowing through the second lamp to output the second detecting signal; and a second decision circuit, coupled to the second detecting circuit and the first control circuit, for controlling the current flowing through the second lamp to output the second decision signal.

7. The lamp duplexing protection apparatus of claim 6, wherein the second control circuit comprises a second feedback compensation circuit and a second modulator.

8. A lamp duplexing protection apparatus, comprising:

a first lamp module comprising a first lamp, coupled to a power source, for outputting a decision signal according to an operating status of the first lamp;

a second lamp module comprising a second lamp, coupled to the power source and the first lamp module, for receiving the first decision signal and outputting a second decision signal according to an operating status of the second lamp; and a third lamp module comprising a third lamp, coupled to the power source, the first lamp module and the second lamp module, for receiving the second decision signal and outputting a third decision signal according to an operating status of the third lamp, wherein the first lamp module receives the third decision signal, the first lamp module determines whether to supply power to the first lamp according to the third decision signal, the second lamp module determines whether to supply power to the second lamp according to the first decision signal, and the third lamp module determines whether to supply power to the third lamp according to the second decision signal.

9. The lamp duplexing protection apparatus of claim 8, wherein the first lamp module comprises:

a first converter, coupled to the power source and the first lamp, for converting electrical power from the power source and supply electrical power to the first lamp;

a first detecting-decision circuit, coupled to the first lamp, for detecting and controlling a current flowing through the first lamp to output a first detecting signal and the first decision signal; and a first control signal, coupled to the first detecting-decision circuit, for receiving the first detecting signal and the second decision signal, and outputting a first control signal according to the first detecting signal and the second decision signal, wherein the first converter determines whether to supply power according to the first control signal.

10. The lamp duplexing protection apparatus of claim 9, wherein the first detecting-decision circuit comprises:

a first detecting circuit, coupled to the first lamp, for detecting the current flowing through the first lamp to output the first detecting signal; and a first decision circuit, coupled to the first detecting circuit, for controlling the current flowing through the first lamp to output the first decision signal.

11. The lamp duplexing protection apparatus of claim 10, wherein the first control circuit comprises a first feedback compensation circuit and a first modulator.

12. The lamp duplexing protection apparatus of claim 11, wherein the second lamp module comprises:

a second converter, coupled to the power source and the second lamp, for converting electrical power from the power source and supply electrical power to the second lamp;

a second detecting-decision circuit, coupled to the second lamp, for detecting and controlling a current flowing through the second lamp to output a second detecting signal and the second decision signal; and a second control signal, coupled to the second detecting-decision circuit, for receiving the second detecting signal and the first decision signal, and outputting a second control signal according to the second detecting signal and the first decision signal, wherein the second converter determines whether to supply power according to the second control signal.

13. The lamp duplexing protection apparatus of claim 12, wherein the second detecting-decision circuit comprises:

a second detecting circuit, coupled to the second lamp, for detecting the current flowing through the second lamp to output the second detecting signal; and a second decision circuit, coupled to the second detecting circuit and the first control circuit, for controlling the current flowing through the second lamp to output the second decision signal.

14. The lamp duplexing protection apparatus of claim 13, wherein the second control circuit comprises a second feedback compensation circuit and a second modulator.

15. The lamp duplexing protection apparatus of claim 14, wherein the third lamp module comprises:

a third converter, coupled to the power source and the third lamp, for converting electrical power from the power source and supply electrical power to the third lamp;

a third detecting-decision circuit, coupled to the third lamp, for detecting and controlling a current flowing through the third lamp to output a third detecting signal and the third decision signal; and a third control signal, coupled to the third detecting-decision circuit and the second decision circuit, for receiving the third detecting signal and the second decision signal and outputting a third control signal according to the third detecting signal and the second decision signal, wherein the third convener determines whether to supply power according to the third control signal.

16. The lamp duplexing protection apparatus of claim 15, wherein the third detecting-decision circuit comprises:

a third detecting circuit, coupled to the third lamp, for detecting the current flowing through the third lamp to output the third detecting signal; and a third decision circuit, coupled to the third detecting circuit and the first control circuit, for controlling the current flowing through the third lamp to output the third decision signal.

17. The lamp duplexing protection apparatus of claim 16, wherein the third control circuit comprises a third feedback compensation circuit and a third modulator.

* * * * *